US005188224A

United States Patent [19]

Kinoshita et al.

[11] Patent Number: 5,188,224

[45] Date of Patent: Feb. 23, 1993

[54] COTTON BALES AND METHOD OF PRODUCING SAME

[75] Inventors: Tsukasa Kinoshita; Masahiko Yamada; Hirokazu Matsueda, all of Aichi, Japan

[73] Assignee: Takemoto Yushi Kabushiki Kaisha, Aichi, Japan

[21] Appl. No.: 727,830

[22] Filed: Jul. 9, 1991

[30] Foreign Application Priority Data

Jul. 27, 1990 [JP] Japan ..... 2-200985
Nov. 8, 1990 [JP] Japan ..... 2-305709

[51] Int. Cl.[5] ..... B65D 81/22

[52] U.S. Cl. ..... 206/83.5; 206/524.6; 428/290; 428/391; 428/447; 428/452; 428/540

[58] Field of Search ..... 428/290, 391, 447, 452, 428/540; 206/83.5, 524.6

[56] References Cited

U.S. PATENT DOCUMENTS 4,978,561 12/1990 Cray et al. ..... 427/387

*Primary Examiner*—D. S. Nakarani
*Attorney, Agent, or Firm*—Heller, Ehrman, White & McAuliffe

[57] ABSTRACT

As cotton bales are produced by obtaining lint cotton by subjecting collected seed cotton to a ginning process, linear polyorganosiloxane of a specified type which has 10–6000 siloxane units and is insoluble or dispersive in water is adhesively attached to the seed cotton or to the lint cotton by 0.03–2.0 weight % with respect to the lint cotton.

7 Claims, No Drawings

COTTON BALES AND METHOD OF PRODUCING SAME

BACKGROUND OF THE INVENTION

This invention relates to cotton bales and an improved method of producing the same. More particularly, this invention relates to baled lint cotton with small moisture absorbing and emitting property and a method of producing bales of such cotton.

Cotton bales are produced generally by subjecting collected seed cotton to a ginning process whereby seeds and cotton fibers are separated, removing burrs, leaves, stems and other trash from the separated fibers to obtain lint cotton, and compressing the lint cotton. For reasons of practicality in the trade of cotton bales, seed cotton or lint cotton of a low quality which would adversely affect the commercial value of the produced cotton bale may be removed and water may be sprayed to the seed cotton or lint cotton in order to roughly adjust their moisture regain during their production process.

Since seed cotton and lint cotton which is obtained therefrom are mainly composed of cellulose fibers, they absorb and emit moisture more strongly than synthetic fibers such as polyesters and nylon and their moisture regain varies significantly by the changes in the temperature and humidity of the environment. Moreover, quality of seed cotton and lint cotton, such as the amount of sugar contents, the amount of so-called honeydew (insect secretion) which is attached and the amount of mixed unripe fibers, varies greatly, depending on the climate and soil conditions of the region, the method of planting and their variety. The greater their amounts, the greater the hygroscopicity as compared to normal cotton.

The moisture regain of cotton bales produced by a conventional method as described above changes significantly due to changes in the environmental conditions such as temperature and humidity because of the moisture absorbing and emitting property of seed cotton and lint cotton obtained therefrom. For this reason, cotton bales produced by a conventional method have the following problems.

Firstly, if cotton bales from lint cotton, which was already high or normal in moisture regain, absorb more humidity from the environment while they are being stored or being transported, they are easily mildewed or invaded by bacteria. As a result, they may become discolored or malodorous, or their strength may be adversely affected.

Secondly, if baled lint cotton absorbs moisture from the environment while being stored or transported such that the official moisture regain is exceeded, it is commercially a very significant disadvantage.

Thirdly, high-density compressed cotton bales are advantageous because the cost of their transporatation and storage is low. For this reason, it is a common practice to preliminarily apply moisture to baled lint cotton such that its moisture regain becomes about 9–11%. This is so as to humidify the cotton fibers and to thereby reduce their Young's modulus such that they can be compressed more efficiently. This method is being practiced both in India and in Pakistan where cotton bales of density 520–570 kgs/m$^3$ are being produced. High-density cotton bales thus produced suffer from the fatal disadvantage explained above. Fourthly, such high-density cotton bales do not return efficiently to the original condition before the compression and this adversely affects the handling of cotton blocks after the bales are opened.

SUMMARY OF THE INVENTION

It is therefore a general object of the invention to provide improved cotton bales with which the problems mentioned above can be eliminated and a method of producing such improved cotton bales.

It is a more particular object of the invention to provide cotton bales with only small changes in moisture regain in the baled lint cotton and a method of producing such cotton bales.

It is another object of the invention to provide cotton bales which can be efficiently compressed and can recover efficiently from a compressed condition.

The present invention has been accomplished by the present inventors who diligently carried out researches in view of the above and other objects and is based on their discovery as a result of their studies that good results can be obtained if a specified amount of polyorganosiloxane of a specified structure is applied.

DETAILED DESCRIPTION OF THE INVENTION

The present invention relates, in one aspect thereof, to a cotton bale comprising baled lint cotton characterized as having adhesively attached thereon 0.03–2.0 weight % of linear polyorganosiloxane having 10–6000 siloxane units and being insoluble or dispersive in water or preferably polyorganosiloxane shown below by Equation I or II. In another aspect, the present invention relates to a method of producing cotton bales by obtaining lint cotton by subjecting seed cotton to a ginning process and a compression process characterized wherein 0.03–2.0 weight % of linear polyorganosiloxane having 10–6000 siloxane units and being insoluble or dispersive in water or preferably polyorganosiloxane shown below by Equation I or II is adhesively attached to the seed cotton or lint cotton.

Equation I is given by $T^1OA_aB_bT^2$ where A and B are connected in a block or random manner; A is a dimethyl siloxane unit shown by

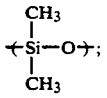

B is a modified siloxane unit shown by

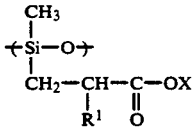

or

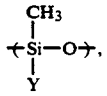

X and Y are hydrogen or an organic group selected from the group consisting of alkyl group, aromatic hydrocarbon group and aralkyl group with 2–18 carbon atoms, $-(CH_2)_e-O-R^3$, $-(CH_2)_f-Si(CH_3)_g(OR^4)_{3-g}$, $$-(CH_2)_h-\underset{\underset{R^5}{|}}{N}-(CH_2)_j-Si(CH_3)_k(OR^6)_{3-k},$$

$$-CH_2-\underset{\underset{O}{\diagdown\ \diagup}}{CH}-CH_2,$$

$$-(CH_2)_n-O-CH_2-\underset{\underset{O}{\diagdown\ \diagup}}{CH}-CH_2,$$

$$-(CH_2)_n-N(R^7)_2,$$

$$-(CH_2)_p-\underset{\underset{R^8}{|}}{N}-(CH_2)_q-N(R^9)_2,$$

$$-(CH_2)_r-N^{\oplus}(R^{10})_3.Z^{\ominus},$$

$$-(CH_2)_t-Si(CH_3)_u(\underset{\underset{O}{\|}}{OC}-R^{11})_{3-u},$$

$R^3$ is hydrogen, alkyl group with 1-18 carbon atoms or alkanoyl group with 1-18 carbon atoms; $R^4$, $R^6$ and $R^{10}$ are alkyl groups with 1-3 carbon atoms; $R^5$, $R^7$, $R^8$ and $R^9$ are hydrogen or alkyl group with 1-3 carbon atoms; $R^{11}$ is alkyl group with 1-17 carbon atoms; $Z^-$ is an anion group; e, f, h, j, m, n, p, q, r and t are 2 or 3; g, k and u are integers 0-3; and $R^1$ is hydrogen or methyl group. $T^1$ and $T^2$ are polysiloxane end group shown by $-Si(CH_3)_v(OR^2)_{3-v}$, $-Si(CH_3)_3$, $-SiH(CH_3)_2$ or $-H$ where $R^2$ is alkyl group with 1-3 carbon atoms; v is an integer 0-3; a is an integer 10-2000; and b is 0 or an integer such that $b \leqq 2a$.

Equation II is given by $T^1OA_aD_dT^2$ where A and D are connected in a block or random manner; A, $T^1$, $T^2$ and a are as defined above; D is modified siloxane unit given by $$\left(\underset{\underset{R^{12}-O-(R^{13}O)_w-R^{14}}{|}}{\overset{\overset{CH_3}{|}}{Si}}-O\right)$$

$R^{12}$ and $R^{13}$ are alkylene groups with 2-3 carbon atoms; $R^{14}$ is hydrogen, alkyl group with 1-18 carbon atoms or alkanoyl group with 1-18 carbon atoms; w is an integer 1-100; d is an integer such that $1 \leqq d \leqq 2a$; and the polyalkylene oxide group inside $(\ )_w$ is single addition of ethylene oxide or propylene oxide or their block or random addition amounting to less than 50 weight % of polyorganosiloxane.

Polyorganosiloxane according to the present invention is linear polyorganosiloxane having 10-6000 siloxane units and being insoluble or dispersive in water, or preferably polydimethylsiloxane having dimethylsiloxane units as indispensable constituents or its derivative as shown in Equations I and II. The unit which constitutes the main chain of polyorganosiloxane shown by Equation I may contain modified siloxane units shown by B besides dimethylsiloxane units shown by A. Examples of such modified siloxane unit include the following:

(1) Alkyl modified, aryl modified, aralkyl modified or alkoxyalkyl modified siloxane units such as butyl.methyl siloxane units, octyl.methyl siloxane units, octadecyl.methyl siloxane units, phenyl.methyl siloxane units, benzyl.methyl siloxane units and butoxypropyl.methyl siloxane units;

(2) Siloxane units modified by organic groups having alkyl group, aryl group or aralkyl group such as 2-lauroxy carbonyl propyl.methyl siloxane units, phenoxy carbonyl ethyl.methyl siloxane units and phenylmethoxy carbonyl ethyl.methyl siloxane units;

(3) Siloxane units modified by organic groups having alkoxysilyl group such as trimethoxy silylethyl.methyl siloxane units, dimethoxy methylsilylethyl.methyl siloxane units, triethoxysilylpropyl.methyl siloxane units, 2-trimethoxysilylethyl-oxycarbonylpropyl.methyl siloxane units, and 2-(N-dimethoxymethylsilylethyl, N-methylamino)-ethyl.methyl siloxane units;

(4) Siloxane units modified by organic groups having epoxy group such as γ-glycidoxypropyl.methyl siloxane units, glycidyl.methyl siloxane units, and 2-glycidoxycarbonylpropyl.methyl siloxane units;

(5) Siloxane units modified by organic groups having amino group such as γ-aminopropyl.methyl siloxane units, N,N-dimethyl-γ-aminopropyl.methyl siloxane units, N-(β-aminoethyl)-γ-aminopropyl.methyl siloxane units, and 2-aminoethyloxycarbonylethyl.methyl siloxane units;

(6) Siloxane units modified by organic groups having quaternary ammonium group such as N,N-dimethyl-γ-aminopropyl.methyl siloxane units quaternarized by methyl chloride, and N,N-dimethyl-γ-aminopropyl.methyl siloxane units quaternarized by dimethyl sulfate;

(7) Siloxane units modified by organic groups having alkanoylsilyl group such as tri-lauroylsilylethyl.methyl siloxane units, and diacetylmethylsilylpropyloxycarbonylethyl.methyl siloxane units; and (8) Methyl.hydrogen siloxane units.

Modified polyorganosiloxanes having modified siloxane units as mentioned above can be obtained by a known method, that is, by the hydrosilylation reaction between polydimethylhydrogen siloxane having methylhydrogen siloxane units and a compound having one carbon-carbon double bond in its molecule. Examples of such compound having one carbon-carbon double bond include the following:

(1) Functional derivatives of (meth)acrylic acid ester such as (meth)acrylic acid esters, glycidyl (meth)acrylate, 2-aminoethyl (meth)acrylate, and dimethylaminopropyl (meth)acrylate;

(2) α,β-unsaturated hydrocarbons such as styrene, α-methylstyrene, and α-olefin;

(3) α,β-alkenylalkyl ethers such as dodecylvinylethers and octylallyl ethers; and (4) Functional derivatives having vinyl or allyl group such as dimethylalkoxyvinyl silane, allylglycidyl ether and allyldimethyl amine.

Regarding polyorganosiloxane shown by Equation I, the repetition number of dimethyl siloxane units shown by A is within the range of 10-2000 and more preferably within the range of 40-300. The repetition number of modified siloxane units shown by B is 0 or less than twice the aforementioned repetition number of dimethyl siloxane and more preferably less than one-half of the aforementioned repetition number of dimethyl siloxane. The polysiloxane end groups shown by $T^1$ and $T^2$ are as described above but more preferably trimethyl siloxane group.

Examples of polyorganosiloxane shown by Equation I and usable advantageously according to the present invention include the following:

$Me_3SiO(Me_2SiO)_{50}SiMe_3$,
$Me_3SiO(Me_2SiO)_{100}SiMe_3$, $Me_3SiO(Me_2SiO)_{100}(MeSiO)_3SiMe_3$
$|$
$(CH_2)_7CH_3$ $Me_3SiO(Me_2SiO)_{200}(MeSiO)_{14}SiMe_3$
$|$
$H$ $Me_3SiO(Me_2SiO)_{100}(MeSiO)_7SiMe_3$
$|$
$(CH_2)_2Si(OMe)_3$ $Me_3SiO(Me_2SiO)_{40}(MeSiO)_7SiMe_3$
$|$
$(CH_2)_3OCH_2-CH(O)CH_2$ $Me_3SiO(Me_2SiO)_{100}(MeSiO)_3SiMe_3$
$|$
$(CH_2)_3NH_2$ $Me_3SiO(Me_2SiO)_{200}(MeSiO)_6SiMe_3$
$|$
$(CH_2)_3N^{\oplus}Me_3Cl^{\ominus}$ $Me_3SiO(Me_2SiO)_{99}H$,
$H(Me_2SiO)_{150}H$, $CH_3O-Si(Me)(OCH_3)O(Me_2SiO)_{250}SiMe_3$ $Me_3SiO(Me_2SiO)_{100}(MeSiO)_7SiMe_3$
$|$
$CH_2-CH(CH_3)-C(=O)-O-C_{12}H_{25}$ $Me_3SiO(Me_2SiO)_{150}(MeSiO)_{15}SiMe_3$
$|$
$CH_2-CH(CH_3)-C(=O)-O-CH_2-CH(O)CH_2$ $Me_3SiO(Me_2SiO)_{200}(MeSiO)_{20}SiMe_3$
$|$
$CH_2-CH_2-C(=O)-O-CH_2CH_2NH_2$ $Me_3SiO(Me_2SiO)_{100}(MeSiO)_7SiMe_3$
$|$
$CH_2-CH_2-C(=O)-O-C_3H_6N^{\oplus}(Me)_3CH_3SO_4^{\ominus}$ where Me indicates a methyl group.

Regarding polyorganosiloxane shown by Equation II, the units which constitute the main chain include dimethyl siloxane shown by A and modified siloxane units shown by D. Examples of such modified siloxane units include the following:

(1) Siloxane units modified by organic groups having polyethylene oxide group such as methoxy polyethoxy propyl.methyl siloxane units, and butoxy polyethoxy ethyl.methyl siloxane units;

(2) Siloxane units modified by organic groups having polypropylene oxide group such as methoxy polypropoxy propyl.methyl siloxane units, and ethoxy polypropoxy ethyl.methyl siloxane units; and (3) Alkoxy polyethoxy polypropoxy propyl.methyl siloxane units with random or block addition of ethylene oxide and propylene oxide.

Modified polyorganosiloxane having modified siloxane units as described above can be obtained by a known process, that is, by the hydrosilylation reaction between polydimethylhydrogen siloxane having methylhydrogen siloxane units and $\alpha,\beta$-alkenoxy polyalkylene glycol ethers. Examples of such $\alpha,\beta$-alkenoxy polyalkylene glycol ethers include the following:

(1) Methoxy polyethylene glycol allyl ether;

(2) Butoxy polyethylene glycol vinyl ether;

(3) Methoxy polypropylene glycol allyl ether;

(4) Ethoxy polypropylene glycol vinyl ether;

(5) Alkoxy polyalkylene glycol allyl ether with random or block addition of ethylene oxide and propylene oxide;

(6) Polyethylene glycol monoallyl ether;

(7) Polyethylene glycol monovinyl ether;

(8) Polypropylene glycol monoallyl ether;

(9) Polypropylene glycol monovinyl ether;

(10) Polyalkylene glycol monoallyl ether with random or block addition of ethylene oxide and propylene oxide;

(11) Aliphatic acid esters of polyalkylene glycol monoallyl ethers of (6), (8) and (10); and

(12) Aliphatic acid esters of polyalkylene glycol monovinyl ethers of (7) and (9).

Regarding polyorganosiloxane shown by Equation II, the repetition number of dimethyl siloxane units shown by A is within the range of 10–2000 and more preferably within the range of 40–300. The repetition number of modified siloxane units shown by D is equal to or greater than 1 and less than twice the repetition number of the aforementioned dimethyl siloxane units and more preferably less than one quarter of this repetition number of the dimethyl siloxane units. The polysiloxane end groups shown by $T^1$ and $T^2$ are as explained above and more preferably trimethyl siloxane.

The alkylene oxide group shown by $R^{13}O$ is preferably propylene oxide alone or a mixture of ethylene oxide and propylene oxide. In the case of a mixture, the ratio of propylene oxide is preferably greater than 50 molar %.

Polyorganosiloxanes shown by Equation II can be soluble, dispersive and insoluble in water, depending on factors such as the ratio between dimethyl siloxane units and modified siloxane units, the kind of alkylene oxide group and the ratio of the molar numbers of addition of ethylene oxide groups and propylene oxide groups. For the purpose of the present invention, use is made of those which are either insoluble or dispersive in water and more preferably those which are practically water-insoluble. This is why those containing less than 50 weight % of polyalkylene oxide group in polyorganosiloxane are selected.

Practical examples of polyorganosiloxane shown by Equation II according to the present invention include the following although they do not limit the scope of the present invention:

$Me_3SiO(Me_2SiO)_{50}(MeSiO)_3SiMe_3$
$|$
$C_3H_6O(EO)_5CH_3$
{AO = 13.4%}

$Me_3SiO(Me_2SiO)_{200}(MeSiO)_5SiMe_3$
$|$
$C_2H_4(EO)_{10}C_4H_9$
{AO = 12.3%}

-continued $$Me_3SiO(Me_2SiO)_{50}(Me_2SiO)_5SiMe_3 \quad | \quad C_3H_6O(PO)_{15}CH_3$$

{AO = 49.3%}

$$Me_3SiO(Me_2SiO)_{100}(MeSiO)_{30}SiMe_3 \quad | \quad C_2H_4O(PO)_5C_2H_5$$

{AO = 43.0%}

$$Me_3SiO(Me_2SiO)_{50}(Me_2SiO)_5SiMe_3 \quad | \quad C_3H_6O\{(EO)_5/(PO)_{10}\}CH_3$$

{R addition, AO = 48.9%}

$$Me_3SiO(Me_2SiO)_{200}(MeSiO)_5SiMe_3 \quad \text{└─} C_2H_4O\{(EO)_{10}/(PO)_{10}\}CH_3$$

{B addition, AO = 24.7%}

$$Me_3SiO(Me_2SiO)_{40}(MeSiO)_{10}SiMe_3 \quad \text{└─} C_3H_5O\{(EO)_5/(PO)_5\}C_{12}H_{25}$$

{B addition, AO = 46.0%}

$$Me_3SiO(Me_2SiO)_{100}(MeSiO)_{25}SiMe_3 \quad | \quad C_3H_6O(PO)_5H$$

{AO = 40.9%}

$$Me_3SiO(Me_2SiO)_{200}(MeSiO)_{10}SiMe_3 \quad | \quad C_2H_4O(EO)_5H$$

{AO = 12.1%}

$$Me_3SiO(Me_2SiO)_{40}(MeSiO)_{10}SiMe_3 \quad | \quad C_3H_6O\{(EO)_2/(PO)_3\}C(=O)-CH_3$$

{B addition, AO = 35.7%}

$$Me_3SiO(Me_2SiO)_{40}(MeSiO)_{10}SiMe_3 \quad | \quad C_2H_4O(EO)_5C(=O)-CH_3$$

{AO = 32.5%}

In the above and in what follows, Me indicates methyl group, EO indicates ethylene oxide, PO indicates propylene oxide, B Addition indicates block-type mixed addition of EO and PO, R Addition indicates random-type mixed addition of EO and PO, and AO indicates the weight % of alkylene oxide group in polyorganosiloxane.

According to the present invention, linear polyorganosiloxane which has 10–6000 siloxane units and is either insoluble or dispersive in water, or more particularly polyorganosiloxane shown by Equation 1 or Equation 2 is applied to seed cotton or ginned cotton obtained from seed cotton. Polyorganosiloxane may be applied in its neat form or in the form of a solution by using an appropriate solvent, but it is preferable to use it in the form of an aqueous emulsion because both the appropriate amount of polyorganosiloxane to be adhesively attached and the moisture regain of ginned cotton can be controlled at the same time.

An aqueous emulsion of polyorganosiloxane can be prepared by a mechanical emulsifying means either with or without the additional use of a surfactant. If a surfactant is to be used supplementarily, it is preferable to use a non-ionic surfactant such as polyoxyalkylene alkylether, polyoxyalkylene alkylphenylether and alkyleneoxide adduct of castor oil. Practical examples of such non-ionic surfactant include straight-chain or branched higher alcohol to which ethylene oxide is added by 3–20 moles, nonylphenyl to which ethylene oxide is added by 3–20 moles and castor oil to which ethylene oxide is added by 10–100 moles. One with appropriate HLB should be selected according to the kind of polyorganosiloxane.

When a surfactant is used supplementarily in the preparation of an aqueous emulsion of polyorganosiloxane, its mixing ratio should be preferably less than 30 weight %, and more preferably less than 15 weight % of the total including both polyorganosiloxane and the surfactant. An aqueous emulsion of polyorganosiloxane is normally used at 1–20 weight % as concentration of the agent inclusive of the supplementarily used surfactant and is thus adhesively attached to seed cotton which has been collected or ginned cotton obtained through a ginning process. Polyorganosiloxane should be already adhesively attached to ginned cotton when it is made into bales.

Application of polyorganosiloxane onto seed cotton and ginned cotton can be effected by any method such as by spraying or immersion but the adhesively attached amount of polyorganosiloxane should be 0.03–2.0 weight %, or more preferably 0.1–0.7 weight % of ginned cotton to be compressed and baled. Cotton bales produced by compressing ginned cotton onto which polyorganosiloxane has been adhesively attached can be maintained at a constant level of moisture regain for a long time since the moisture emitting and absorbing characteristics of the ginned cotton have already been reduced. In other words, the present invention makes it possible at the time of production of cotton bales to adjust the moisture regain of ginned cotton to be compressed and baled. In such a situation, the moisture regain of ginned cotton is adjusted to 6.0–8.5, or more preferably to 7.0–8.2.

When polyorganosiloxane (either in the neat form or in a diluted form in a solvent) is adhesively to ginned cotton, if the moisture regain of the ginned cotton is below a specified level, water is preliminarily applied to the ginned cotton. If the moisture of the ginned cotton is higher than the specified level, on the contrary, the ginned cotton is preliminarily dried by a hot-air drying process or the like so as to prepare its moisture regain. When polyorganosiloxane in the form of an aqueous emulsion is adhesively to ginned cotton, the moisture regain of the ginned cotton can similarly be adjusted to a specified level by controlling the concentration of the emulsion or the applied amount. If the moisture regain of ginned cotton has become higher than the specified level as a result of the attachment, the moisture regain can be adjusted, for example, by drying it in a warm or hot wind of room temperature—80° C. with relative humidity below 60%. When ginned cotton is dried after an aqueous emulsion has been adhesively thereto, use may preferably be made of polyorganosiloxane such as polydimethyl hydrogen siloxane, alkoxy modified polydimethyl siloxane and epoxy modified polydimethyl siloxane and the drying should preferably be carried out by means of hot wind of 50°–80° C.

Cotton bales according to the present invention of specified weight and dimensions are produced from such ginned cotton with polyorganosiloxane attached thereto by using a bale press to compress it into bags of hemp cloth, cotton cloth or nylon cloth or jute bags. Although this invention is not limited by any method of pressing, any particular type of bale press to be used, the dimensions of cotton bale or the quantity which is compressed and packed, it is to be noted that high-density cotton bales can be produced according to the present invention because of the superior compression characteristics of ginned cotton with a specified amount of polyorganosiloxane applied thereto. According to the present invention, for example, cotton bales of compressed density in excess of 600 kgs/m$^3$ can be produced without difficulty.

In what follows, test results will be presented in order to described the essence and effects of the invention more clearly but these exemplary test results are not intended to limit the scope of the invention.

TEST 1 (WITH TEST EXAMPLES 1–4 AND COMPARISON EXAMPLES 1–4)

Allen seed cotton from Central Western Africa was subjected to a ginning process to obtain ginned cotton by eliminating trash such as seed crusts, leaves, stems, sand and gravel. Table 1 shows the characteristics of the ginned cotton thus obtained. On the chute immediately before the ginned cotton is introduced into a press box, 10-weight % aqueous emulsions of Agents A, B, C and D as described in Table 2 were applied by spraying such that the amount of each emulsion adhesively attached to the ginned cotton became 2.2 weight %. In this operation, the target amount of polyorganosiloxane in the aqueous emulsion adhesively attached to the ginned cotton was 0.2 weight % and the target moisture regain of the ginned cotton was 8.3%. In Table 1, moisture regain is the weight of water contained in 100 g of cotton under condition of 30% RH. In Table 2 and hereinbelow, repetition numbers of dimethyl siloxane units and modified siloxane units are average values; Me indicates methyl group; POE indicates polyoxyethylene; and the number inside ( ) indicates the average condensation number of oxyethylene groups. R-1 was used as a representative example of water-proofing or water-repellant agent and R-2 was used as a representative example of water-holding or water-absorbing agent.

The ginned cotton thus treated was introduced into a press box of area 137 cm (length)×51 cm (width)=0.699 m$^2$ and use was made of a gin standard bale press (with cylinder diameter of oil press=38 cm and maximum gauge pressure=140 kg/cm$^2$) for compression to produce cotton bales (Test Examples 1–4) of net weight=216 kg, dimensions=140 cm (length)×51 cm (width)×63.5 cm (thickness) and pressed density=476.4 kgs/m$^3$. For the packaging of these cotton bales, use was made of bags of hemp cloth and 9 stainless steel wire straps.

For the purpose of comparison, 10-weight % aqueous emulsions of Agents R-1 and R-2 as shown also in Table 2 were applied by spraying to ginned cotton obtained from Allen seed cotton similarly as above on the chute immediately before the introduction of the ginned cotton into the press box such that the amount of each aqueous emulsion adhesively attached to the ginned cotton became 2.2 weight %. Cotton bales (Comparison Examples 1 and 2) were produced in the same manners from these ginned cotton with these aqueous emulsions attached thereto. Separately from the above, cotton bales of another kind (Comparison Example 3) were produced in an identical manner as above except water was applied instead of an aqueous emulsion of any agent at 2.4 weight %. Cotton bales of still another kind (Comparison Example 4) were produced in an identical manner as above except neither water nor an aqueous emulsion of any agent was adhesively attached to the ginned cotton.

Ten cotton bales each of the Examples were prepared and they were divided into Group 1 and Group 2 of five bales each. The bales of Group 1 were kept under the conditions of 25° C. and 30% RH for 3 months. Those of Group 2 were kept under the conditions of 35° C. and 80% RH for 3 months. Thereafter, these bales were opened by removing the steel wires and the bags and the cotton blocks, from which external constraining force was thus removed, were further left for 48 hours under the conditions of 20° C. and 65% RH. For each of the examples, the moisture regain of ginned cotton immediately before compression and packaging, the maximum gauge pressure value of the oil press at the time of compression and packaging, the moisture regain of the cotton block immediately after the package was removed and after it was left, the "compressed recovery ratio" and "tear off" of the cotton block after the package was opened and it was left, and the amount of adhesively attached polyorganosiloxane was measured or evaluated. The results are shown in Table 3. In Table 3 and hereinbelow, the adhesively attached amount is the amount of polyorganosiloxane; the numbers inside () indicate the values obtained by subtracting wax portion from the extracted amount of n-hexane; *1 indicates the moisture regain of ginned cotton immediately before the compression and packaging; *2 indicates the moisture regain of ginned cotton immediately after the unpacking; and *3 indicates the moisture regain of cotton block after it has been opened and left.

The results of Tables 1 and 3 were obtained as follows. The moisture regain, compressed recovery ration, tear off and amount of adhesively attached polyorganosiloxane are averaged values.

The amount of honeydew was evaluated by the Benedict method according to JIS L 1019-1972 (Japanese Industrial Standards) in terms of "None", "Very Little", "Little", "Some" and "Much". The moisture regain was measured by the method according to JIS L 1019-1972.

The compressed recovery ratio was calculated by the following formula by measuring at eight different places the length, width and thickness of each cotton block after it has been left for 48 hours at 20° C. and 65% RH to obtain the average values of length (×cm), width (y cm) and thickness (z cm): Compressed Recovery Ratio $=\{xyz/(140\times51\times63.5)\}\times100$.

For the tear off, the upper section of each of the cotton block, after its compressed recovery ratio was measured as above, was torn off at a position about 10 cm from the top surface. The tear off was evaluated as follows:

A: The tear off was very easy.

B: Slight resistance was sensed.

C: Some resistance was felt but it can be torn off at a constant thickness.

D: Significant resistance against tear off and it cannot be torn off at a constant thickness.

To measure the amount of adhesively attached polyorganosiloxane, sample pieces were collected from 5 different places of each cotton block after the tear off test. An extract was obtained from each sample piece by using a Soxley extractor with n-hexane and removing n-hexane from the extract under a condition of reduced pressure. This extract was analyzed by using an inductively coupled plasma emission spectrometer (ICP light-emitting spectrometer) to determine the Si content from a graph which is preliminarily prepared from samples with known concentrations. The amount of adhesively polyorganosiloxane is calculated from the Si content thus obtained.

TABLE 2

| A-gent | Composition | Weight % |
|---|---|---|
| A | $Me_3SiO(Me_2SiO)_{50}SiMe_3$ | 90 |
| | POE(15) oleyl ether | 10 |
| B | $Me_3SiO(Me_2SiO)_{100}(MeSiO)_3SiMe_3$ (with $(CH_2)_7CH_3$) | 90 |
| | POE(15) oleyl ether | 10 |
| C | $Me_3SiO(Me_2SiO)_{50}(MeSiO)_5SiMe_3$ (with $C_3H_6O\{(EO)_5(PO)_{10}\}CH_3$) | 90 |
| | {R addition, AO = 48.9%} POE(15) oleyl ether | 10 |
| D | $Me_3SiO(Me_2SiO)_{50}(MeSiO)_3SiMe_3$ (with $C_3H_6O(EO)_5CH_3$) | 90 |
| | {AO = 13.4%} POE(15) oleyl ether | 10 |
| R-1 | 125° F. paraffin wax | 90 |
| | Sorbitan monostearate | 3 |
| | POE(15) oleyl ether | 7 |
| R-2 | Polyethylene glycol (Molecular weight 2000) | 90 |
| | POE(15) oleyl ether | 10 |

Notes:
The numbers of repetition of dimethyl siloxane units and modified siloxane units are both averaged values;
Me indicates a methyl group;
POE indicates polyoxyethylene and the number inside ( ) indicates the average condenstion of oxyethylene group;
R-1 is intended as a representative water-resistant and water-repellant agent; and
R-2 is intended as a representative water-holding and water-absorbing agent.

TEST 2 (WITH TEST EXAMPLES 5-8 AND COMPARISON EXAMPLES 5-8)

Texas seed cotton from Texas, U.S.A. was subjected to a ginning process to obtain ginned cotton as in Test 1. This ginned cotton had average fiber length of 2.62 cm, average fiber fineness of 1.77 μm/cm, moisture regain (35% RH) of 6.0%, wax components of 0.39% and somewhat much honeydew. As in Test 1, it was sprayed with 13.7-weight % aqueous emulsions of Agents E—H, R—3 and R—4 shown in Table 4 such that the adhesively attached amount of each aqueous emulsion would be 2.2 weight % with respect to the ginned cotton. In this operation, the target amount of polyorganosiloxane in the aqueous emulsion adhesively attached to the ginned cotton was 0.27 weight % and the target moisture regain of the ginned cotton was 8.0%.

The ginned cotton thus treated was introduced into a press box of area 137 cm (length)×51 cm (width)=0.699 $m^2$ and use was made of a bale press (with cylinder diameter of oil press=40.6 cm and maximum gauge pressure=314 kg/$cm^2$) for compression to produce cotton bales (Test Examples 5-8 and Comparison Examples 5 and 6) of net weight=252 kg, dimensions=140 cm (length)×51 cm (width)×51 cm (thickness) and pressed density=692 kgs/$m^3$. For the packaging of these cotton bales, use was made of bags of hemp cloth and 8 stainless steel wire straps.

For the purpose of comparison as in Test 1, cotton bales (Comparison Example 7) were produced by using ginned cotton to which water was sprayed instead of an aqueous emulsion of any agent. An attempt was further made to produce cotton bales of still another kind (Comparison Example 8) in an identical manner as above except neither water nor an aqueous emulsion of any agent was sprayed to the ginned cotton but was stopped for safety reasons because the gauge pressure of the oil press exceeded 300 kg/$cm^2$ during the compression and packaging process.

Five cotton bales each of the Examples were prepared (except Comparison Example 8) and after they were kept under the conditions of 35° C. and 65% RH for 120 days, they were opened by removing the steel wire straps and the bags. The cotton blocks, from which external constraining force was thus removed, were further left for one week under the conditions of 35° C. and 65% RH. For each of the samples, measurements and observations were made of the moisture regain of

TABLE 3

| Examples | Agent Type | Agent Weight % | Maximum gauge pressure (kg/$cm^2$) | Moisture Regain (%) Group 1 *1 | Group 1 *2 | Group 1 *3 | Group 2 *2 | Group 2 *3 | Compressed Recovery Rate (%) Gr. 1 | Compressed Recovery Rate (%) Gr. 2 | Tear off Gr. 1 | Tear off Gr. 2 |
|---|---|---|---|---|---|---|---|---|---|---|---|---|
| Test 1 | A | 0.21 | 114 | 8.2 | 7.6 | 8.4 | 8.9 | 8.5 | 195 | 156 | A | B |
| Test 2 | B | 0.20 | 116 | 8.1 | 7.5 | 8.4 | 8.8 | 8.4 | 201 | 161 | A | B |
| Test 3 | C | 0.20 | 116 | 8.3 | 7.7 | 8.5 | 9.0 | 8.6 | 190 | 148 | A | B |
| Test 4 | D | 0.20 | 116 | 8.3 | 8.1 | 8.4 | 8.8 | 8.4 | 196 | 153 | A | B |
| Comp 1 | R-1 | (0.21) | 123 | 8.0 | 5.6 | 9.1 | 11.9 | 9.2 | 168 | 116 | C | D |
| Comp 2 | R-2 | (0.23) | 126 | 8.3 | 6.2 | 10.0 | 12.8 | 10.2 | 144 | 107 | D | D |
| Comp 3 | Water | — | 124 | 8.1 | 5.6 | 9.6 | 12.5 | 9.8 | 152 | 105 | D | D |
| Comp 4 | None* | — | 135 | 6.8 | 5.4 | 9.6 | 11.8 | 9.7 | 160 | 105 | C-D | D |

Notes:
Test: Test Examples
Comp: Comparison Examples
The amount of adhesively attached agent (weight %) is the amount of polyorganosiloxane;
The numbers inside ( ) indicate the values obtained by subtracting wax portion from the extracted amount of n-hexane;
*1: The moisture regain of ginned cotton immediately before the compression and packaging;
*2: The moisture regain of ginned cotton immediately after the unpacking;
*3: The moisture regain of cotton block after it has been opened and left.
None*: Not processed

TABLE 1

| | |
|---|---|
| Average Fiber Length | 2.62 cm |
| Average Fiber Fineness | 1.6 μg/cm |
| Moisture Regain (30% RH) | 6.2% |
| Wax | 0.42% |
| Honeydew | Much |

ginned cotton immediately before compression and packaging, the maximum gauge pressure value of the oil press at the time of compression and packaging, the moisture regain of the cotton block immediately after the package was removed and after it was left, the thickness recovery ratio, appearance and "tear off" of the cotton block after the package was opened and it was left, and the amount of adhesively attached polyorganosiloxane. The results are shown in Table 5. The results of Table 5 were obtained as explained above with reference to Test 1 except as described below. In Table 5, the thickness recovery ratio (TRR), external appearance (EA), tear off (TO) and the amount of adhesively polyorganosiloxane are averaged values.

TABLE 5

| Examples | Agent Type | Agent Weight % | Maximum gauge pressure (kg/cm$^2$) | Moisture regain (%) *1 | Moisture regain (%) *2 | TRR (%) | EA | TO |
|---|---|---|---|---|---|---|---|---|
| Test 5 | E | 0.28 | 256 | 7.8 | 8.3 | 121 | A | A-B |
| Test 6 | F | 0.28 | 252 | 8.0 | 8.4 | 120 | A | A |
| Test 7 | G | 0.28 | 254 | 8.0 | 8.3 | 122 | A | A |
| Test 8 | H | 0.29 | 257 | 7.9 | 8.3 | 120 | A | B-A |
| Test 9 | I | 0.29 | 259 | 7.9 | 8.4 | 124 | A | A-B |
| Test 10 | J | 0.29 | 255 | 7.9 | 8.4 | 126 | A | A |
| Test 11 | K | 0.29 | 258 | 8.0 | 8.4 | 125 | A | A |
| Comp 5 | R-3 | (0.27) | 273 | 7.8 | 9.1 | 110 | B | C |
| Comp 6 | R-4 | (0.27) | 270 | 7.8 | 9.3 | 108 | B | C |
| Comp 7 | Water | — | 278 | 7.9 | 10.1 | 105 | C | D |
| Comp | None | — | — | 6.0 | — | — | — | — |

TABLE 4

| Agent | Composition | Weight % |
|---|---|---|
| E | $Me_3SiO(Me_2SiO)_{100}(MeSiO)_3SiMe_3$ <br> $\vert$ <br> $(CH_2)_3NH_2$ | 90 |
| | POE(15) oleyl ether | 10 |
| F | $Me_3SiO(Me_2SiO)_{100}(MeSiO)_7SiMe_3$ <br> $\vert$ <br> $CH_2-CH_2-C(=O)-O-C_3H_6N^+(Me)_3CH_3SO_4^-$ | 97 |
| | POE(15) oleyl ether | 3 |
| G | $Me_3SiO(Me_2SiO)_{200}(MeSiO)_5SiMe_3$ <br> $\vert$ <br> $C_2H_4O(EO)_{10}C_4H_9$ | 90 |
| | {AO = 12.3%} <br> POE(15) oleyl ether | 10 |
| H | $Me_3SiO(Me_2SiO)_{100}(MeSiO)_{30}SiMe_3$ <br> $\vert$ <br> $C_2H_4O(PO)_5C_2H_5$ | 90 |
| | {AO = 43.0%} <br> POE(15) oleyl ether | 10 |
| R-3 | $Me_3SiO(Me_2SiO)_7SiMe_3$ | 90 |
| | POE(15) oleyl ether | 10 |
| R-4 | $Me_3SiO(Me_2SiO)_3(MeSiO)_4SiMe_3$ <br> $\vert$ <br> $C_3H_6O(EO)_5H$ | 90 |
| | POE(15) oleyl ether | 10 |
| I | $Me_3SiO(Me_2SiO)_{50}SiMe_3$ | 95 |
| | POE(5) nonylphenyl ether | 5 |
| J | $Me_3SiO(Me_2SiO)_{40}(MeSiO)_{10}SiMe_3$ <br> $\vert$ <br> $C_3H_6O\{(EO)_2/(PO)_3\}C(=O)-CH_3$ | 95 |
| | {B addition, AO = 35.7%} <br> POE(15) oleyl ether | 5 |
| K | $Me_3SiO(Me_2SiO)_{40}(MeSiO)_{10}SiMe_3$ <br> $\vert$ <br> $C_3H_6O\{(EO)_5/(PO)_5\}C_{12}H_{25}$ | 95 |
| | {B addition, AO = 46.0%} <br> POE(15) oleyl ether | 5 |

TABLE 5-continued

| Examples | Agent Type | Agent Weight % | Maximum gauge pressure (kg/cm²) | Moisture regain (%) *1 | Moisture regain (%) *2 | TRR (%) | EA | TO |
|---|---|---|---|---|---|---|---|---|
| 8 | | | | | | | | |

Notes:
Test: Test examples
Comp: Comaprison examples
TRR: Thickness recovery rate
EA: External appearance
TO: Tear off Thickness recovery ratio of each sample was obtained by measuring the thickness of the cotton block at 8 different places to obtain their average value (h cm) and calculating as follows: Thickness Recovery Ratio (%)={h/51}×100.

Appearance of each cotton block was functionally evaluated as follows after its thickness recovery ratio had been measured:

A: No abnormality is observed;

B: Slight musty odor and yellowing parts are slightly observed;

C: Strong musty odor and many yellowing parts.

TEST 3 (WITH TEST EXAMPLES 9-11)

Ginned cotton of Test 2 obtained by subjecting Texas seed cotton from Texas, U.S.A. to a ginning process was first sprayed with water such that the amount of water adhesively attached to the ginned cotton would be 2 weight %. It was then sprayed with Agents I-K in their neat forms such that the amount of the agents adhesively attached to the ginned cotton would be 0.30 weight %. Thereafter, cotton bales (Test Examples 9-11) were obtained therefrom in the same manner as in Test 2. These Test Examples were measured and evaluated as in Test 2. The results are also shown in Table 5.

TEST 4 (WITH TEST EXAMPLES 12 AND 13 AND COMPARISON EXAMPLE 9)

Upland seed cotton from Alabama, U.S.A. was subjected to a ginning process to obtain ginned cotton as in Test 1. This ginned cotton had average fiber length of 3.18 cm, average fiber fineness of 1.65 μm/cm, moisture regain (60% RH) of 8.1%, wax components of 0.43% and a small amount of honeydew. It was sprayed with 5-weight % aqueous emulsions of Agents L and M shown in Table 6 such that the adhesively amount of each aqueous emulsion would be 10 weight % with respect to the ginned cotton. It was then dried with hot air of 80° C.

The dried ginned cotton was introduced into a press box of area 137 cm (length)×51 cm (width)=0.699 m² and use was made of a bale press (with cylinder diameter of oil press=44.1 cm and maximum gauge pressure=348 kg/cm²) for compression to produce cotton bales (Test Examples 12 and 13) of net weight=450 kg, dimensions=140 cm (length)×51 cm (width)×80 cm (thickness) and pressed density=788 kgs/m³. For the packaging of these cotton bales, use was made of bags of hemp cloth and 8 steel bands. For the purpose of comparison, cotton bales (Comparison Example 9) were additionally produced by using the ginned cotton directly without applying any aqueous emulsion of agent.

Five cotton bales each of the Examples were prepared and after they were kept under the conditions of 20° C. and 65% RH for 120 days, they were opened to remove the external force due to the bag and the steel bands. Thereafter, measurements and evaluations were carried out as in Test 2. The moisture regain after the unpacking was measured at 20° C. and 65% RH and it was the same as the official moisture regain.

TEST 5 (WITH TEST EXAMPLE 14)

The ginned cotton of Test 4 obtained by subjecting Upland seed cotton to a ginning process was sprayed with Agent N of Table 4 in its neat form such that the adhesively attached amount of the agent would be 0.60 weight % with respect to the ginned cotton. Cotton bales were produced therefrom as in Test 4 without drying the ginned cotton. Five cotton bales thus produced were used for measurements and evaluations as in Test 4. The results are shown in Table 7.

As can be seen from the results of the measurements and evaluations, the present invention has the favorable effect of reducing moisture emitting and absorbing characteristics of baled lint cotton although seed cotton and ginned cotton produced from seed cotton have many undesirable characteristics. As a result, the moisture regain of cotton bales according to the present invention does not vary greatly in spite of changes in the environmental temperature and humidity and their characteristics at the time of baling can be maintained for a long time during their storage and transportation. Additionally, cotton bales of the present invention can be effectively compressed and have superior compressed recovery ratios when they are opened.

TABLE 6

| Agent | Composition | Weight % |
|---|---|---|
| L | $Me_3SiO(Me_2SiO)_{100}(MeSiO)_7SiMe_3$ with $(CH_2)_2Si(OMe)_3$ | 90 |
| | POE(15) oleyl ether | 10 |
| M | $Me_3SiO(Me_2SiO)_{200}(MeSiO)_{14}SiMe_3$ with H | 90 |
| | POE(15) oleyl ether | 10 |
| N | $Me_3SiO(Me_2SiO)_{40}(MeSiO)_7$ with $(CH_2)_3OCH_2-CH(O)CH_2$ | |

TABLE 7

| Examples | Agent Type | Agent Weight % | Maximum gauge pressure (kg/cm²) | Moisture regain (%) *1 | Moisture regain (%) *2 |
|---|---|---|---|---|---|
| Test 12 | L | 0.49 | 304 | 8.2 | 8.2 |
| Test 13 | M | 0.50 | 307 | 8.2 | 8.3 |
| Test 14 | N | 0.60 | 310 | 8.1 | 8.4 |
| Comp 9 | None | — | 329 | 8.1 | 8.8 |

What is claimed is:

1. In a cotton bale comprising baled lint cotton, the improvement wherein linear polyorganosiloxane which has 10-6000 siloxane units and is insoluble or dispersive in water is adhesively attached to said baled lint cotton by 0.03-2.0 weight %.

2. The cotton bale of claim 1 wherein said polyorganosiloxane is of the form $T^1OA_aB_bT^2$ where A and B are connected in a block or random manner; A is a dimethyl siloxane unit shown by

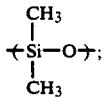

B is a modified siloxane unit shown by

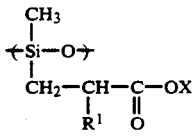

or

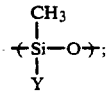

x and y are hydrogen or an organic group selected from the group consisting of alkyl group, aromatic hydrocarbon group and aralkyl group with 2-18 carbon atoms, $-(CH_2)_e-O-R^3$, $$-(CH_2)_f-Si(CH_3)_g(OR^4)_{3-g},$$

$$-(CH_2)_h-\underset{\underset{R^5}{|}}{N}-(CH_2)_j-Si(CH_3)_k(OR^6)_{3-k},$$

$$-CH_2-\underset{\underset{O}{\diagdown\ \diagup}}{CH-CH_2},$$

$$-(CH_2)_m-O-CH_2-\underset{\underset{O}{\diagdown\ \diagup}}{CH-CH_2},$$

$$-(CH_2)_n-N(R^7)_2,$$

$$-(CH_2)_p-\underset{\underset{R^8}{|}}{N}-(CH_2)_q-N(R^9)_2,$$

$$-(CH_2)_r-N^{\oplus}(R^{10})_3.Z^{\ominus}, \text{ and}$$

$$-(CH_2)_t-Si(CH_3)_u(\underset{\underset{O}{\|}}{OC}-R^{11})_{3-u}$$

$R^3$ is hydrogen, alkyl group with 1-18 carbon atoms or alkanoyl group with 1-18 carbon atoms; $R^4$, $R^6$ and $R^{10}$ are alkyl groups with 1-3 carbon atoms; $R^5$, $R^7$, $R^8$ and $R^9$ are hydrogen or alkyl group with 1-3 carbon atoms; $R^{11}$ is alkyl group with 1-17 carbon atoms; $Z^{\ominus}$ is an anion group; e, f, h, j, m, n, p, q, r and t are 2 or 3; g, k and u are integers 0-3; $R^1$ is hydrogen or methyl group; $T^1$ and $T^2$ are polysiloxane end group shown by $-Si(CH_3)_v(OR^2)_{3-v}$, $-Si(CH_3)_3$, $-SiH(CH_3)_2$ or $-H$; $R^2$ is alkyl group with 1-3 carbon atoms; v is an integer 0-3; a is an integer 10-2000; and b is 0 or an integer such that $b \leqq 2a$.

3. The cotton bale of claim 1 wherein said polyorganosiloxane is of the form $T^1OA_aD_dT^2$ where A and D are connected in a block or random manner; A is a dimethyl siloxane unit shown by

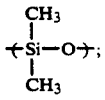

$T^1$ and $T^2$ are polysiloxane end group shown by $-Si(CH_3)_v(OR^2)_{3-v}$, $-Si(CH_3)_3$, $-SiH(CH_3)_2$ or $-H$; $R^2$ is alkyl group with 1-3 carbon atoms; v is an integer 0-3; a is an integer 10-2000; D is modified siloxane unit given by

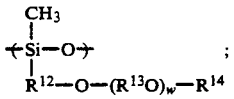

$R^{12}$ and $R^{13}$ are alkylene groups with 2-3 carbon atoms; $R^{14}$ is hydrogen, alkyl group with 1-18 carbon atoms or alkanoyl group with 1-18 carbon atoms; w is an integer 1-100; d is an integer such that $1 \leqq d \leqq 2a$; and the polyalkylene oxide group inside $(\ )_w$ is single addition of ethylene oxide or propylene oxide or their block or random addition amounting to less than 50 weight % of polyorganosiloxane.

4. The cotton bale of claim 2 wherein said baled lint cotton has moisture regain of less than 8.5% at 20° C. and 65% RH.

5. The cotton bale of claim 3 wherein said baled lint cotton has moisture regain of less than 8.5% at 20° C. and 65% RH.

6. The cotton bale of claim 2 wherein the packed density of said baled lint cotton is over 600 kgs/m$^3$.

7. The cotton bale of claim 3 wherein the packed density of said baled lint cotton is over 600 kgs/m$^3$.

* * * * *